United States Patent [19]

Buschman

[11] 4,102,072

[45] Jul. 25, 1978

[54] DISPLAY DEVICE FOR HOLDING PAINT CHIP CARDS

[75] Inventor: Edward M. Buschman, New York, N.Y.

[73] Assignee: Display Corporation International, Milwaukee, Wis.

[21] Appl. No.: 778,691

[22] Filed: Mar. 17, 1977

[51] Int. Cl.[2] ..... G09F 1/10

[52] U.S. Cl. ..... 40/124.2; 40/10 R

[58] Field of Search ..... 211/55; 40/124, 124.2, 40/10, 124.2

[56] References Cited

U.S. PATENT DOCUMENTS

| | | | |
|---|---|---|---|
| 1,156,401 | 10/1915 | Hawley | 40/124.2 |
| 1,449,045 | 3/1923 | Hollander | 40/124.2 |
| 3,198,340 | 8/1965 | Tokash | 211/55 X |
| 3,612,292 | 10/1971 | Nervig | 211/55 |

*Primary Examiner*—Louis G. Mancene
*Assistant Examiner*—Wenceslao J. Contreras

[57] ABSTRACT

A display device has wall means made up of adjacent overlapping back walls and step walls extending therebetween to define a plurality of rectangular channels adapted for removably holding paint chip cards. The channels are arranged in parallel, staggered relation at angles with respect to and extending between a pair of spaced parallel planes so that the device accords a display of at least a portion of each of the paint chip cards held within the channels.

7 Claims, 4 Drawing Figures

DISPLAY DEVICE FOR HOLDING PAINT CHIP CARDS

BACKGROUND OF THE INVENTION

I. Field of the Invention

This invention relates generally to a point-of-purchase display device, and more particularly, to such a display device adapted for removably holding a plurality of placards such as paint chip cards.

II. Description of the Prior Art.

Display devices for holding placards such as paint chip cards are widely used for point-of-purchase display of the various shades of colors of paint or other decorator medium available from a particular manufacturer. Heretofore, such display devices have generally required a considerable amount of display area and have been limited with regard to side-by-side placement of paint chip cards vis-a-vis other paint chip cards having different shading or colors.

This invention is concerned with this general area and has among its objects to provide a display device which eliminates the above noted and other disadvantages of the prior art.

More specifically, this invention has among its objects to provide a display device which provides a relative increase in the number of placards or paint chip cards which can be held and effectively displaced utilizing a given display area.

The invention also has among its objects to provide a display device which provides improved and versatile side-by-side placement of particular paint chip cards vis-a-vis other paint chip cards.

Further, the invention has among its objects to provide a display device which includes the above noted features and which has a simplified and economical construction.

SUMMARY OF THE INVENTION

The invention provides a display device for removably holding a plurality of placards such as paint chip cards. The device includes wall means for defining a plurality of compartments or channels arranged in parallel, staggered relation at angles with respect to and extending between a pair of spaced parallel planes.

More particularly, the wall means are made up of adjacent overlapping back walls having step walls extending therebetween to define the channels. Outer walls preferably extend laterally from edges of the back walls opposite the step walls to give the channels a rectangular shape.

The back walls are preferably made up of coplanar extensions which correspond to and overlap an open area in an adjacent back wall. The display device can be injection molded from a clear or transparent plastic, affords versatile placement of the paint chip cards vis-a-vis one another, and provides for the display or visual observation of at least a portion of each of the paint chip cards held within the channels.

Other features and advantages of the preferred embodiment of the invention will become known by reference to the following general description, the drawing, and the appended claims.

DESCRIPTION OF THE PREFERRED EMBODIMENT

Figure 1:
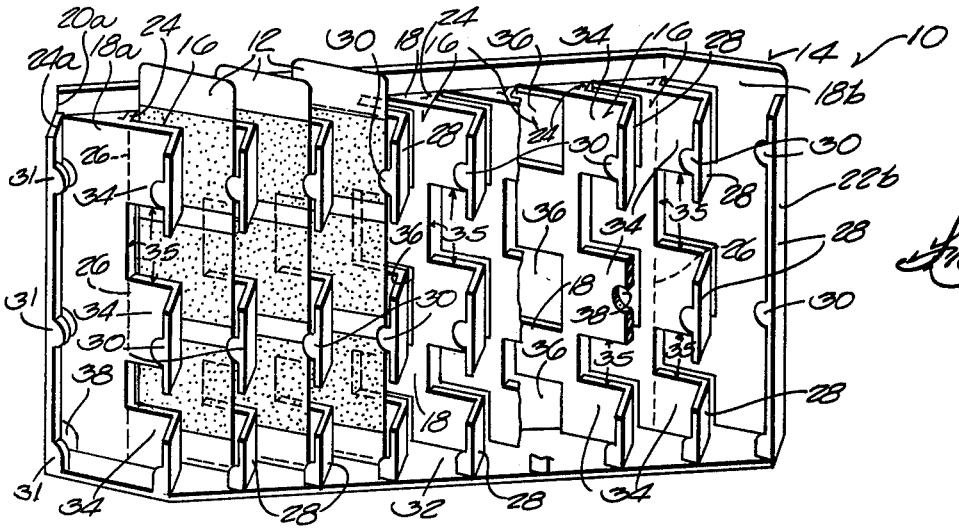
FIG. 1 is a front perspective view of a display device embodying the invention, the device being shown with portions broken away for illustration purposes.

Referring more particularly to the drawings, wherein like numerals refer to like parts throughout the several views, FIG. 1 shows a display device 10 adapted for removably holding a plurality of paint chip cards 12. The device includes wall means 14 which define a plurality of compartments or channels 16 adapted for holding the cards 12. The channels 16 are arranged in parallel staggered relation at angles with respect to and extending between a pair of spaced parallel planes, designated P1 and P3 (shown in FIG. 3) so that the device affords display of at least a portion of each of the paint chip cards 12 held within the channels.

More specifically, the wall means 14 is made up of a plurality of back walls 18, including a first back wall **18*a* and a last back wall 18*b*. The back walls are arranged in parallel staggered relation and each has first and second spaced edges, 20 and 22, respectively. The first edges 20 are located in the first plane designated P1, and the second edges 22 are located in a second plane designated P2 which is parallel to plane P1. The edges of each back wall 18, except the first edge 20*a* of the first back wall 18*a* and the second edge 22*b* of the last back wall 18*b***, are located intermediate the first and second edges of an adjacent back wall so that the adjacent back walls partially overlap.

Figure 2:
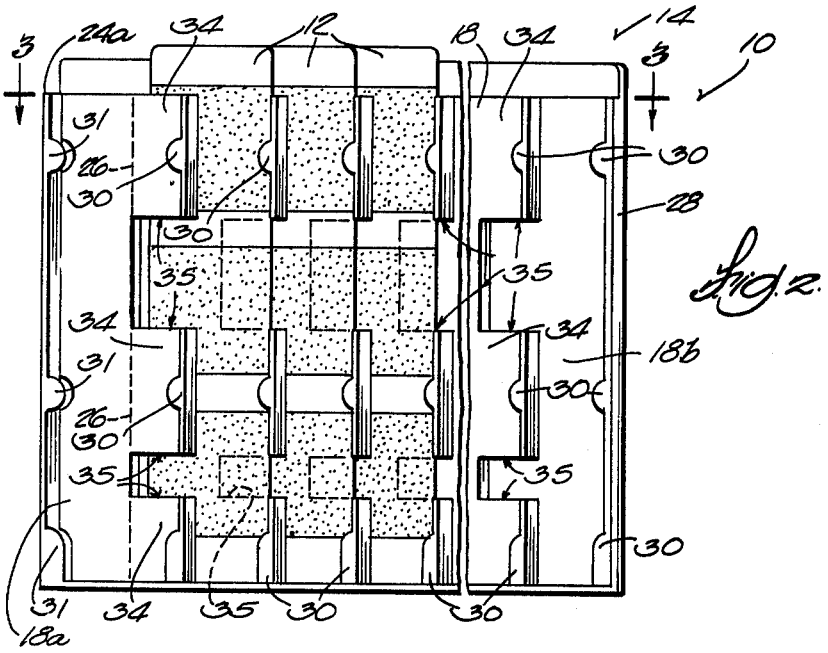
FIG. 2 is a partial front plan view of the display device shown in FIG. 1.

The wall means 14 also include step walls 24 extending from the first edge 20 of each of the back walls 18. Each of the step walls 24, except the step wall **24*a* extending from the first edge 20*a* of the first wall 18*a*, extends to and engages an adjacent one of the back walls 18 at a line (shown by a dashed line 26 in FIGS. 1 and 2**) intermediate the first and second edges of the one back wall.

Figure 3:
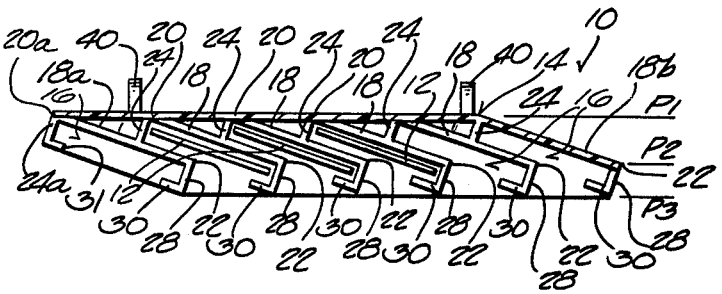
FIG. 3 is a top plan view taken along lines 3—3 of FIG. 2.

In order to better insure that the paint chip cards 12 are held within the compartments or channels 16, the wall means 14 preferably includes an outer wall 28 extending generally perpendicularly from each of the second edges 22 of the back walls in parallel spaced relationship to the respective step wall 24. Each of the outer walls 28 includes a projecting tab 30 extending from the top edge portion thereof toward the respective step wall 24 in parallel spaced relationship to the respective back wall 18. The step wall **24*a* of the first back wall 18*a* also includes tabs 31 which extend toward the adjacent outer wall 28 in parallel spaced relationship to the back wall 18*a*. As is best shown in FIG. 3, the back walls, step walls, outer walls, and tabs partially define a plurality of compartments or channels 16** which are rectangular in shape.

In the illustrated construction, the first and second planes P1 and P2, between which the back walls 18 extend, are vertical. Hence, the rectangular channels 16 are generally vertical and are adapted to removably hold the paint chip cards 12 in a generally vertical position. A bottom wall 32 (best shown in FIG. 1) extends transversely with respect to the vertical planes P1 and P2 and engages bottom edges of the back walls, step walls, and outer walls to provide a bottom surface which supports the paint chip cards. The display device 10 can be constructed so that the channels 16 have a different orientation, e.g. are horizontally disposed.

In order to provide an economical construction, the back walls 18 include co-planar extensions 34 having spaces 35 therebetween and extending outwardly from the lines 26 intermediate the first and second edges of the back walls. The co-planar extensions include the back wall second edges 22 and overlap adjacent back walls. Each of the back walls 18, except the first back wall 18*a*, includes open areas 36 (FIG. 1) corresponding to and registering with the overlapping co-planar extensions 34.

The co-planar extensions 34 and the first back wall 18*a* preferably include smaller open areas 38 which correspond to and register with the projecting tabs. The display device 10 can be simply and economically manufactured by being integrally formed or injection molded from a transparent or clear, lightweight plastic, for example, crystal styrene. In the illustrated construction, the first back wall 18*a* and the last back wall 18*b* are arranged in a slightly different manner than the other back walls. the first back wall 18*a* does not include the open areas 36, while the last back wall 18*b* does not include the spaces 35.

Figure 4:
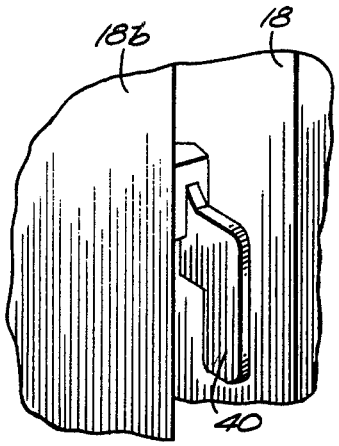
FIG. 4 is a fragmentary rear perspective view of the display device shown in FIG. 1 and illustrates a tab utilized for attachment purposes.

Various attachment means arrangements can be utilized to facilitate securing the display device to a wall surface in a given display area. In the construction shown (see FIG. 4) such attachment means comprises L-shaped hooks or tabs 40 (one shown) which are suitably secured to and extend outwardly from the rear surfaces of the back walls 18, and which are adapted to fit into slots or openings in a wall surface. For counter top display, the bottom wall 32 of the display device can simply be rested on a horizontal counter surface.

The display device 10 is preferably constructed and dimensioned so that the paint chips 18 are removably held within the generally rectangular shaped channels 16, and so that approximately one-half of each of the paint chip cards (the right half as viewed in FIG. 1) is exposed for display. The depth of the channels 16 can be made great enough so that more than one paint chip card can be held within each channel. A card can be removed by a customer when he desires to observe its entire surface or take it with him. When a customer desires to make a side-by-side comparison of different shadings or color, the appropriate cards can be placed in adjacent channels and the overlapping relationship of the channels facilitates a close comparison of several different shadings and/or colors. It should be apparent that the display device affords versatile placement of the paint chip cards and can be utilized to hold and effectively display a relatively large number of paint chip cards within a given display area.

It is to be understood that the invention is not confined to the particular construction and arrangement of parts herein illustrated and described, but is intended to embrace all such modified forms thereof as come within the scope of the following claims.

I claim:

1. A display device adapted to hold elongated paint chip cards comprising, in combination, a plurality of back walls, including a first back wall and a last back wall, said back walls being arranged in parallel staggered relation and each having first and second spaced edges, said first edges being located in a first plane and said second edges being located in a second plane spaced from said first plane, said first and second planes being parallel and said back walls extending at an angle thereto, the edges of each back wall except said first edge of said first back wall and said second edge of said last back wall, being located intermediate the first and second edges of an adjacent back wall so that adjacent back walls partially overlap, and a step wall extending from said first edge of each of said back walls, each of said steps walls, except the back wall, extending to and engaging an adjacent one of said back walls at a line intermediate the first and second edges of said one back wall, said display device being integrally molded from plastic.

2. The display device of claim 1 wherein said back walls include spaced co-planar extensions which extend from said lines intermediate the first and second edges of said back walls wherein said step walls engage said back walls, said co-planar extensions overlapping an adjacent back wall, wherein said back walls, except said first back wall, respectively include open areas corresponding to and registering with said overlapping co-planar extensions, and wherein said display device is integrally molded from clear plastic.

3. The display device of claim 1 further including outer walls respectively extending laterally from said second edges of said back walls opposite said step walls, said back walls, said step walls, and said outer walls partially defining a plurality of compartments adapted for removably holding the paint chip cards in parallel staggered relation.

4. The device of claim 3 wherein each of said outer walls includes a projecting tab extending inwardly generally parallel to said back wall, and wherein said step walls and said outer walls extend generally laterally with respect to said back walls so that said compartments comprise generally rectangular channels.

5. The device of claim 4 further comprising a bottom wall which extends transversely with respect to said first and second planes and engages bottom edges of said back walls, said step walls, and said outer walls, said bottom wall defining a bottom surface of said plurality of rectangular channels adapted to support the paint chip cards, wherein said first and second parallel planes are generally vertical planes, and wherein said plurality of rectangular channels comprise vertical channels.

6. The device of claim 5 further comprising attachment means secured to at least one of said back walls, said attachment means affording securing said device to a wall surface.

7. The display device of claim 4 wherein said back walls, except said last back wall, each include co-planar extensions having spaces therebetween and which extend from said lines intermediate the first and second edges of said back walls where said step walls engage said back walls, said co-planar extensions overlapping an adjacent back wall and including said second edges, wherein said back walls, except said first back wall, respectively include open areas corresponding to and registering with said overlapping co-planar extensions, wherein said co-planar extensions include open areas corresponding to and registering with said tabs, and wherein said display device comprises an integrally formed device injection molded from clear plastic.

* * * * *